US006093085A

United States Patent [19]

Yellitz et al.

[11] Patent Number: 6,093,085

[45] Date of Patent: Jul. 25, 2000

[54] APPARATUSES AND METHODS FOR POLISHING SEMICONDUCTOR WAFERS

[75] Inventors: Bradley J. Yellitz, Austin, Tex.; Peter A. Burke, Newark, Del.

[73] Assignee: Advanced Micro Devices, Inc., Austin, Tex.

[21] Appl. No.: 09/149,166

[22] Filed: Sep. 8, 1998

[51] Int. Cl.[7] ..... B24B 29/00

[52] U.S. Cl. ..... 451/41; 451/288; 451/289; 451/528; 451/921

[58] Field of Search ..... 451/528, 41, 921, 451/289, 527–529, 287–290

[56] References Cited

U.S. PATENT DOCUMENTS

| | | | |
|---|---|---|---|
| 5,435,772 | 7/1995 | Yu . | |
| 5,489,233 | 2/1996 | Cook et al. | 451/41 |
| 5,645,469 | 7/1997 | Burke et al. . | |
| 5,733,176 | 3/1998 | Robinson et al. | 451/41 |
| 5,769,699 | 6/1998 | Yu . | |
| 5,800,248 | 9/1998 | Pant et al. . | |
| 5,853,317 | 12/1998 | Yamamoto | 451/921 |
| 5,897,424 | 4/1999 | Evans et al. | 451/41 |
| 5,899,745 | 5/1999 | Kim et al. . | |
| 5,899,799 | 5/1999 | Tjaden et al. | 451/287 |
| 5,931,719 | 8/1999 | Nagahara et al. | 451/41 |

FOREIGN PATENT DOCUMENTS

| | | |
|---|---|---|
| 3-259520 | 11/1991 | Japan . |
| WO 99/07518 | 2/1999 | WIPO . |

*Primary Examiner*—David A. Scherbel
*Assistant Examiner*—G. Nguyen
*Attorney, Agent, or Firm*—Williams, Morgan & Amerson, P.C.

[57] ABSTRACT

The present disclosure relates to a polishing pad including a pad structure having at least first and second polishing regions defined along a polishing surface of the pad structure. The first polishing region of the pad structure is less compressible than the second polishing region of the pad structure. The present disclosure also relates to a polish platen including a platen structure having at least first and second regions adapted for supporting a polishing pad. The first region of the platen structure is less compressible than the second region of the platen structure.

26 Claims, 6 Drawing Sheets

APPARATUSES AND METHODS FOR POLISHING SEMICONDUCTOR WAFERS

FIELD OF THE INVENTION

The present invention relates generally to apparatuses and methods for fabricating integrated circuit/semiconductor devices. More specifically, the present invention relates to apparatuses and methods for polishing semiconductor wafers.

BACKGROUND OF THE INVENTION

In the manufacture of integrated circuits, the planarization of semiconductor wafers is becoming increasingly important as the number of layers used to form integrated circuits increases. For instance, metallization layers formed to provide interconnects between various devices may result in nonuniform surfaces. The surface nonuniformiities may interfere with the optical resolution of subsequent lithographic steps, leading to difficulty with printing high resolution patterns. The surface nonuniformities may also interfere with step coverage of subsequently deposited metal layers and possibly cause open or shorted circuits.

Various techniques have been developed to planarize the top surface of a semiconductor wafer. One such approach involves polishing the wafer using a polishing slurry that includes abrasive particles mixed in a suspension agent. With this approach, the wafer is mounted in a wafer holder, a polishing pad has its polishing surface coated with the slurry, the pad and the wafer are rotated such that the wafer provides a planetary motion with respect to the pad, and the polishing surface is pressed against an exposed surface of the wafer. The polishing erodes the wafer surface, and the process continues until the wafer is largely flattened. Typically, the slurry is introduced near the center of the pad, forms a ring around the wafer and goes under the wafer as necessary. It is generally desirable to maintain an adequate amount of slurry between the wafer and the pad while dispensing as little slurry as possible to lower costs.

In chemical-mechanical polishing, the slurry particles abrade the wafer surface while a chemical reaction occurs at the wafer surface. For instance, in chemical-mechanical polishing of silicon dioxide, the slurry particles generate high pressure areas that cause the silicon dioxide to react with water. In chemical-mechanical polishing of other materials, such as tungsten, the slurry employs a wet chemical etchant to assist in removing wafer material. The wet chemical etchant is often more selective to the exposed wafer material than to underlying wafer materials.

The polishing pad can be a felt fiber fabric impregnated with polyurethane, with the amount of impregnation determining whether the pad is a "hard pad" or a "soft pad." A hard pad tends to focus the polishing pressure on protruding regions of the wafer surface in order to rapidly planarize the wafer surface. A soft pad tends to create a more even polish over the entire wafer surface, a finer surface finish, and less mechanical damage to the wafer.

A significant goal relating to chemical-mechanical polishing techniques is the maintenance of substantially uniform planarity over the entire surface of a given wafer. Due to problems which will be described in the present application, uniformity is particularly difficult to achieve near the edge of a given wafer.

SUMMARY OF THE INVENTION

One aspect of the present invention relates to a polishing pad adapted for polishing integrated circuit/semiconductor wafers. The polishing pad includes a pad structure having at least first and second polishing regions defined along a polishing surface of the pad structure. The first polishing region of the pad is less compressible than the second polishing region of the pad.

Another aspect of the present invention relates to a polishing platen adapted for polishing integrated circuit/semiconductor wafers. The polishing platen includes a platen structure having at least first and second regions adapted for supporting a polishing pad. The first region of the platen structure is less compressible than the second region of the platen structure.

A further aspect of the present invention relates to a system for polishing semiconductor wafers. The system includes a polishing platen and a drive mechanism for rotating the polishing platen. The system also includes a polishing pad mounted on the polishing platen. The polishing pad includes a polishing surface having first and second polishing regions. The system further includes a source of polishing fluid adapted for providing polishing fluid to the polishing pad. Finally, the system additionally includes means for providing different compressibilities at the first and second polishing regions of the polishing pad.

An additional aspect of the present invention relates to a method for polishing a semiconductor wafer. The method includes providing a polishing pad mounted on a polishing platen. The polishing pad includes a polishing surface having first and second polishing regions. The second polishing region of the polishing pad is more compressible than the first polishing region of the polishing pad. The method also includes rotating the polishing pad, and pressing the semiconductor wafer against the polishing pad. The method additionally includes radially oscillating the semiconductor wafer across the first and second polishing regions.

In accordance with other aspects of the invention, methods and apparatuses for varying the compressibility of a semiconductor polishing pad are provided. In one particular embodiment, regions of different compressibility are provided on a polishing pad by altering the construction of the pad itself. For example, the polishing pad can include a polishing component defining a recess arranged and configured for receiving a cushioning component adapted for varying the compressibility of the pad. In another embodiment of the present invention, the compressibility of a polishing pad is varied by varying the structure of a polishing platen on which the polishing pad is mounted. For example, the polishing platen can include a platen deck or plate defining a recess arranged and configured for receiving a cushioning structure adapted for generating different regions of compressibility on the platen. By using polishing pads including regions having different compressibilities, polishing uniformity near the wafer edge can be improved while maintaining acceptable process uniformity across the bulk of the wafer.

A variety of additional advantages of the invention will be set forth in part in the description which follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION OF THE DRAWINGS

Reference will now be made in detail to exemplary aspects of the present invention which are illustrated in the accompanying drawings. Wherever possible, the same reference numbers will be used throughout the drawings to refer to the same or like parts.

Semiconductor devices are commonly fabricated on silicon wafers by introducing sequentially stacked patterned layers, such as conductive, dielectric and capping layers, on the surfaces of the wafers. As the number of these stacked layers increases, planarization techniques are commonly used to optimize the planarity of such layers. Chemical-mechanical polishing (CMP) processes have been developed, and are widely used, to planarize layer surfaces, such as silicon dioxide surfaces, on wafers such as silicon wafers. One of the significant challenges encountered with planarization through the use of CMP processing techniques is to achieve process uniformity near the wafer edge (approximately the outermost 0.8 mm of the wafer). Using conventional techniques, process uniformity at the outermost edge or portion of a wafer differs greatly from the bulk of the wafer.

Figure 7:
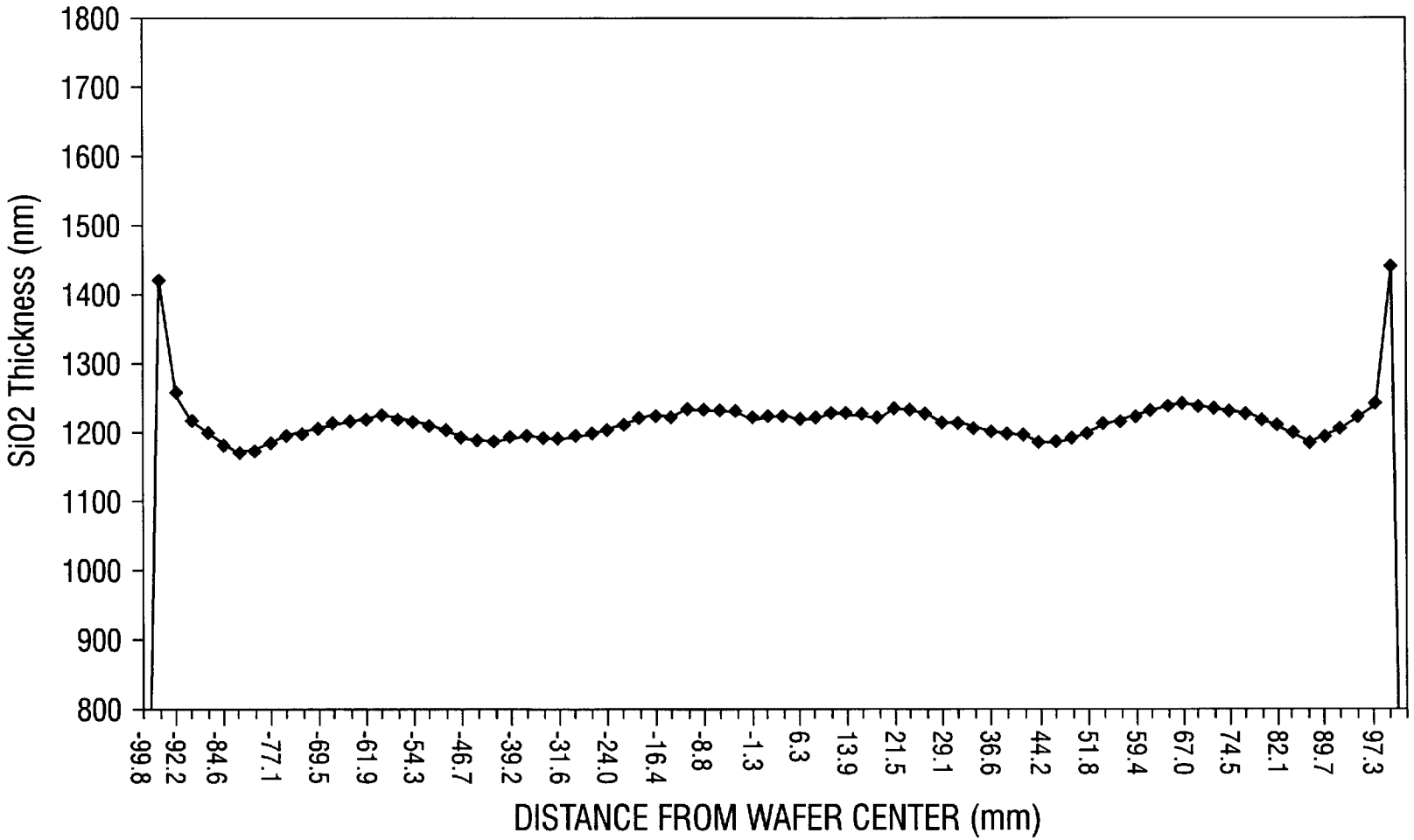
FIG. 7 (PRIOR ART)
FIG. 7 is a graph illustrating the surface contour of a material polished with a conventional polish pad system.

For the removal and planarization of layers, such as silicon dioxide layers, from a wafer surface, a typical polishing system utilizes a polishing pad having a top layer made of a relatively rigid, hard material such as polyurethane, and a bottom layer made of a softer, shock-absorbing material such as felt or foam. This combination provides a mixture of hardness for planarization capability and removal rate, and compressibility for improved process uniformity by dampening system variations. However, the compressibility of the bottom material, which allows for process uniformity across the bulk of the wafer, contributes to the degradation of process uniformity near the wafer edge. Specifically, it has been determined that this occurs because, as the wafer is oscillated across the pad, the pad material compresses as a reaction to polishing forces at the leading edge of the wafer, and then rebounds. This compression and rebound effect is believed to cause non-uniform removal patterns at or near the wafer edge. For example, FIG. 7 illustrates a typical non-uniform removal pattern generated near the edge of a wafer by conventional polish pad systems. The removal pattern of FIG. 7 is just typical, and often the surface non-uniformity generated by conventional polish systems is worse than the pattern specifically shown.

Figure 8:
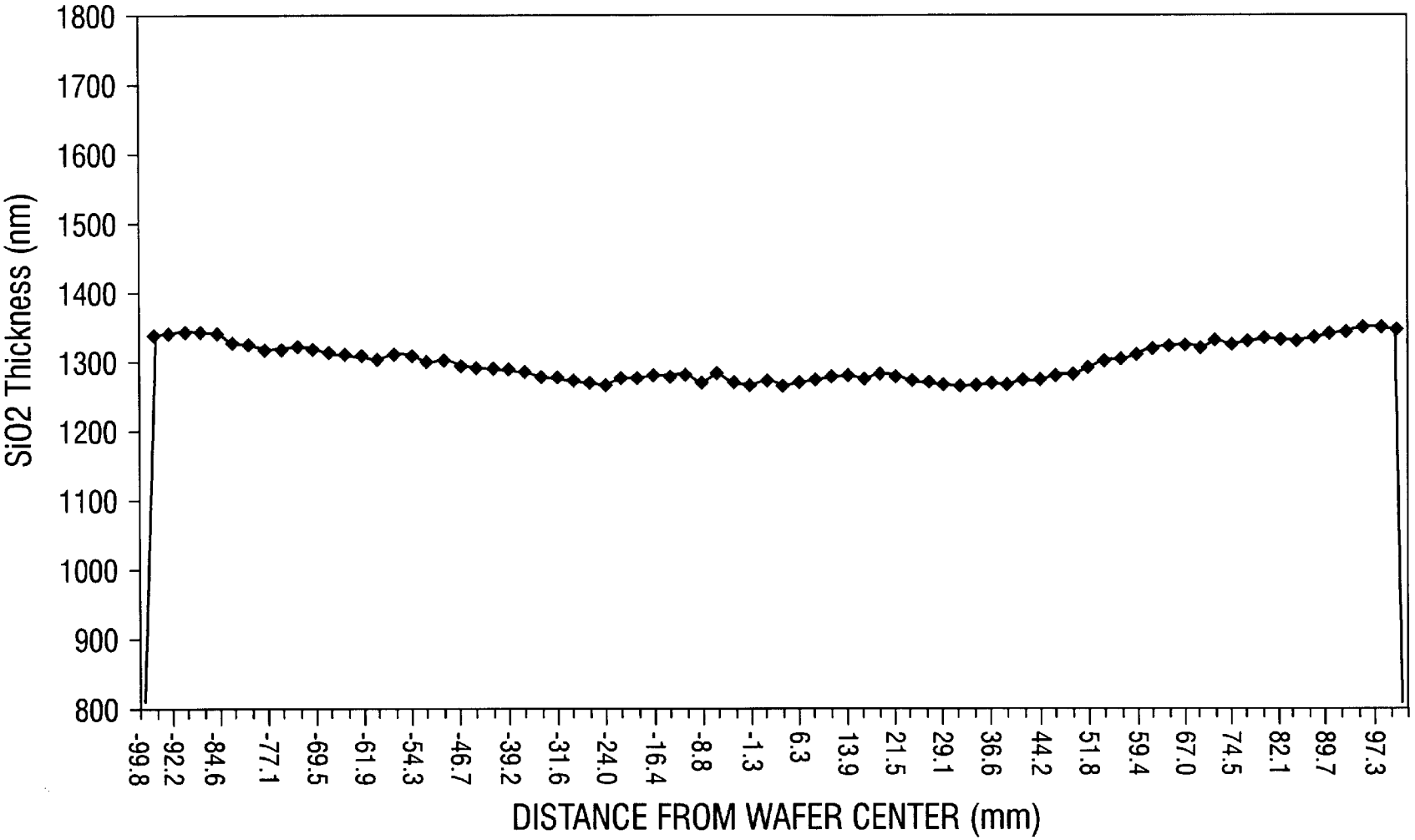
FIG. 8 is a graph illustrating the surface contour of a material polished with a system in accordance with the principles of the present invention.

The present invention teaches that uniformity near the wafer edge can be improved or enhanced by varying a polishing surface construction between an area that most affects the surface of a wafer adjacent the wafer edge and that which most affects the bulk surface of the wafer. For example, the compressibility of a polishing surface can be varied through such exemplary techniques as varying the compressibility of particular regions of a polishing pad, or by varying the compressibility of various regions of a polishing platen. In one particular embodiment, an intermediate radial region of a polishing surface can be made more compressible than a remainder of the polishing surface. It has been determined by the inventors that such a construction allows for acceptable process uniformity across the bulk of a wafer, along with improved process uniformity near the edge of the wafer. FIG. 8 shows the improved process uniformity provided by using a polish system in accordance with the principles of the present invention.

The terms "semiconductor wafer" or "wafer" are used throughout this specification and claims. These terms are intended to include wafer substrates as well as wafers having any number of stacked patterned layers. Furthermore, these terms are intended to include all types of semiconductors/integrated circuit devices as well as precursor semiconductors/semiconductor devices.

Figure 1:
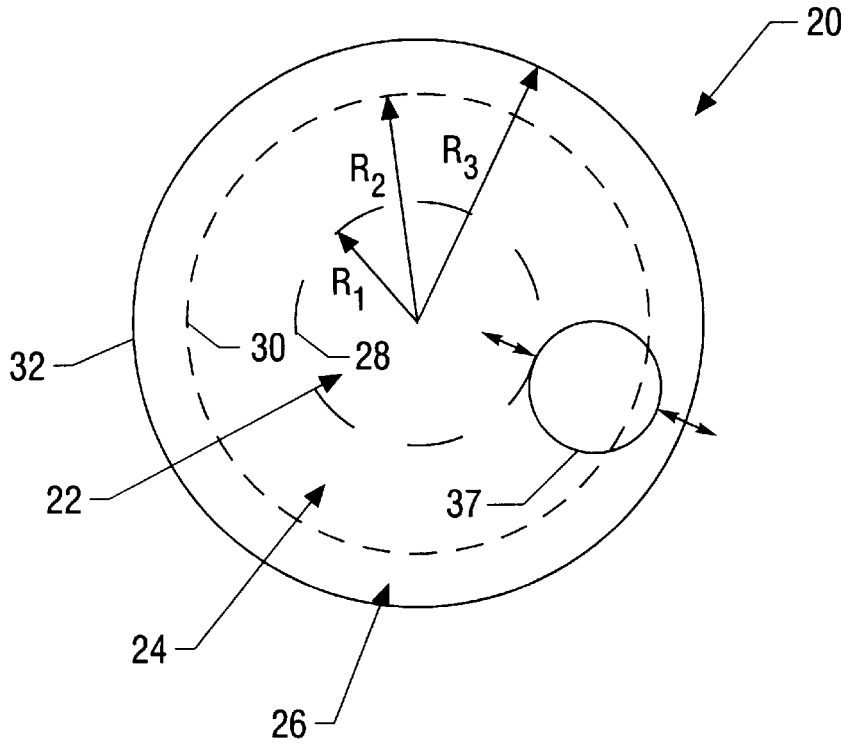
FIG. 1 is a schematic plan view of a polishing pad constructed in accordance with the principles of the present invention.
Figure 2:
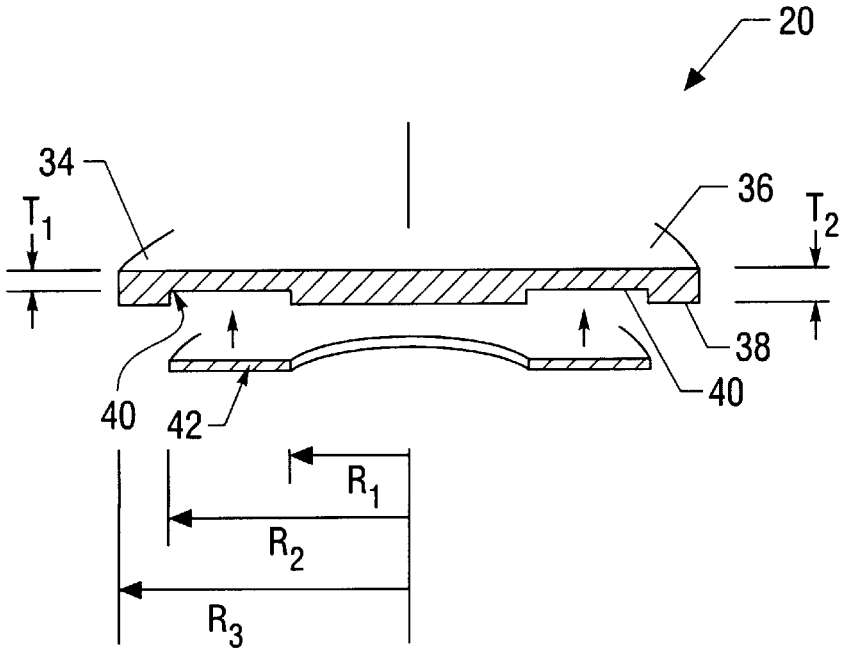
FIG. 2 is a cross-sectional view taken along section line 2—2 of FIG. 1.

FIGS. 1 and 2 illustrate an exemplary polishing pad 20 constructed in accordance with the principles of the present invention. The exemplary polishing pad 20 includes at least first and second polishing regions having different degrees of compressibility. For example, as shown in FIG. 1, the pad 20 includes an inner polishing region 22, an intermediate polishing region 24, and an outer polishing region 26. In one particular embodiment of the present invention, the intermediate polishing region 24 is more compressible than the inner and outer polishing regions 22 and 26. As shown in FIG. 1, the polishing regions 22, 24 and 26 are generally concentrically aligned relative to one another with the inner polishing region 22 being circular and the intermediate and outer polishing regions 24 and 26 being generally annular. In certain embodiments, the pad can define an inner aperture such that that the inner polishing region is annular. However, it will be appreciated that the invention is not limited to the above-described configurations.

Referring back to FIG. 1, a first boundary 28 forming the outer boundary of the inner polishing region 22 is defined by a first radius $R_1$. Also, a second boundary 30 forming an outer boundary of the intermediate polishing region 24 is defined by a second radius $R_2$. Finally, a third boundary 32 coinciding with the outermost edge of the polishing pad 20 and forming an outer boundary of the outer polishing region 26 is defined by a third radius $R_3$. As is apparent from the above description, the inner polishing region 22 is defined by the first boundary 28, the intermediate polishing region 24 is defined between the first and second boundaries 28 and 30, and the outer polishing region 26 is defined between the second and third boundaries 30 and 32.

For many applications, $R_2$ is in the range of 1.5 to 5 times as long as $R_1$, and $R_3$ is in the range of 2 to 8 times as long as $R_1$. In one particular embodiment of the present invention, $R_1$ is about 200 millimeters (mm), $R_2$ is about 355 mm, and $R_3$ is about 405 mm.

Referring now to FIG. 2, an exemplary construction configuration for the polishing pad 20 is illustrated. As shown in FIG. 2, the polishing pad 20 includes a polishing component 34 having a top side 36 forming a polishing surface adapted for polishing a semiconductor wafer 37, and a bottom side 38 adapted to face a polishing platen. The bottom side 38 defines a recess 40 that coincides or corresponds generally with the intermediate polishing region 24. A cushioning component 42 is disposed within and at least partially fills the recess 40. As shown in FIG. 2, the recess 40 and the cushioning component 42 are both annular. However, it will be appreciated that the present invention is not limited to such a configuration.

Because the polishing component 34 is recessed adjacent the intermediate polishing region 24, the polishing component 34 has a greater thickness at the inner and outer polishing regions 22 and 26 as compared to the intermediate polishing region 24. For many applications, the polishing component 34 has a thickness $T_1$ at the intermediate polishing region 24 that is about half as thick as the thickness $T_2$ of the polishing component 34 at the inner and outer polishing regions 22 and 26. In one particular embodiment of the present invention, $T_1$ is about 0.64 mm (0.025 inch) while $T_2$ is about 1.27 mm (0.05 inch). It will be appreciated that the above described ratios and ranges are strictly exemplary and are not intended to be a limitation upon the present invention.

For many applications, the polishing component 34 of the polishing pad 20 is made of a relatively hard, rigid and non-compressible material, while the cushioning component 42 of the pad 20 is made of a relatively soft, resilient, and compressible material. In one particular embodiment, the polishing component is made of a material such as polyurethane or a polyurethane-impregnated polyester felt. Additionally, in one embodiment of the present invention, the cushioning component 42 is made of a material such as felt or foam. In certain embodiments of the present invention, the material used to make the cushioning component is in the range of 5–15 times more compressible than the material used to make the polishing component. Preferably, the material of the cushioning component is about 10 times more compressible than the material of the an polishing component. An exemplary polishing component has a Shore D hardness of 60 while a cushioning component has a Shore A hardness of 65.

Figure 3:
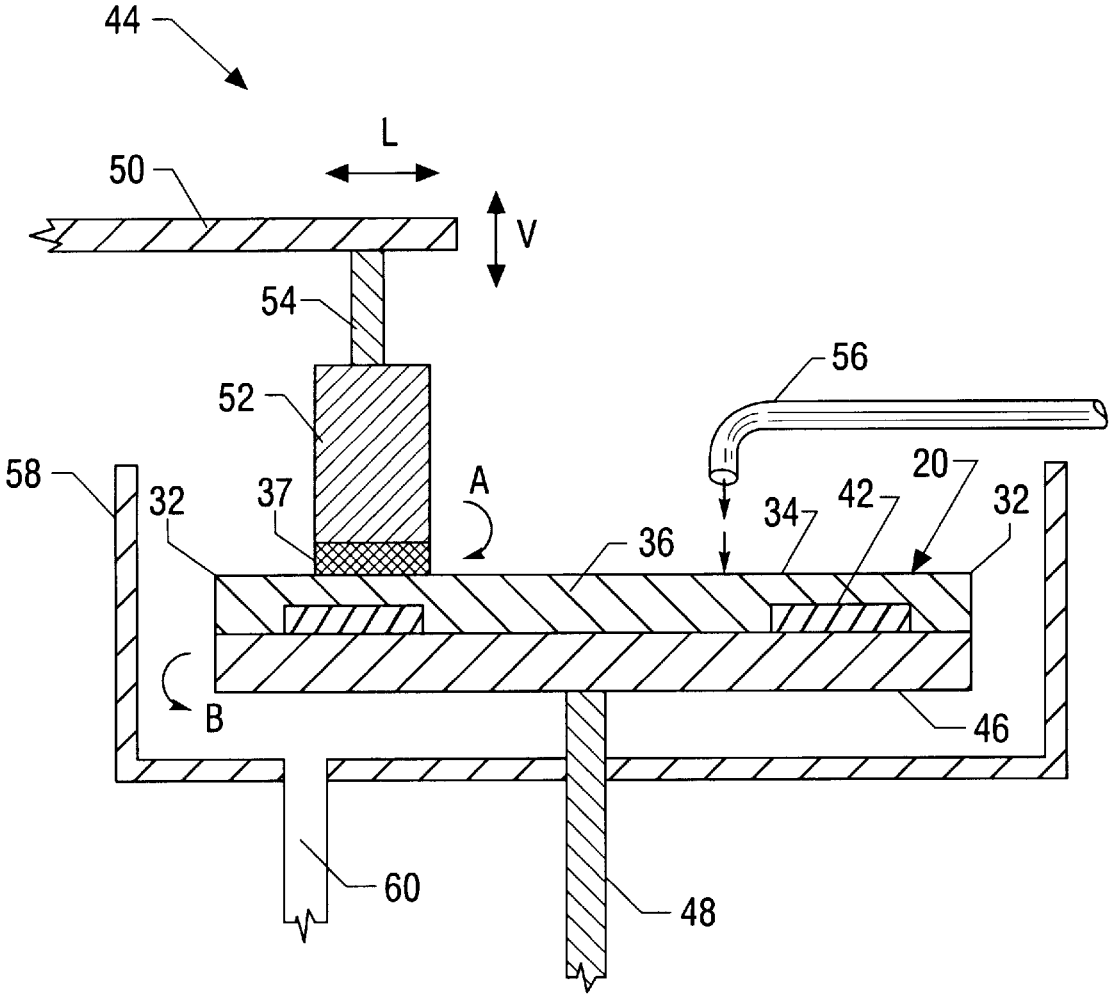
FIG. 3 is a schematic cross-sectional view of a polishing system incorporating the polishing pad of FIG. 1.

FIG. 3 shows a cross-sectional view of a polishing system 44 incorporating the polishing pad 20 described above. The polishing system 44 includes a rotatable platen 46 to which the polishing pad 20 is secured. The platen 46 is rotated about its central axis via a drive spindle 48. The polishing system 44 also includes a polishing arm 50 that is adapted to move both laterally (direction L) and vertically (direction V). The polishing arm 50 includes a wafer holder 52 for removably securing the wafer 37 by such means as a vacuum suction. The wafer holder 52 is rotated by a chuck spindle 54. The polishing system 44 further includes a fluid dispenser 56 for dispensing a fluid onto the polishing pad 20, and a sink 58 for containing materials that are propelled off the polishing pad 20.

An exemplary operation of the system 44 will now be described. Initially, the chuck spindle 54 rotates the wafer holder 52 and the wafer 37 in a clockwise direction A, the drive spindle 48 rotates the platen 46 and the pad 20 in a counterclockwise direction B, the polishing arm 50 holds the wafer 37 above the polishing pad 20, and the dispenser 56 dispenses a polishing slurry onto the polishing surface 36 of the polishing pad 20. After contacting the pad 20, the slurry flows centrifugally toward the outermost boundary 32 of the pad 20 and is slung off the pad 20. Thereafter, the polishing arm 50 is actuated downward so that the wafer 37 is pressed against the top side 36 of the polishing pad 20.

The polishing arm 50 continues to exert a downward pressure to enable the pad 20 and the slurry to erode and polish the wafer 37. Concurrently, the polishing arm 50 radially oscillates the wafer across the inner polishing region 22, the intermediate polishing region 24, and outer polishing region 26. For example, the wafer 37 can be oscillated between outer boundary 32 of the pad 20 and the center of the pad 20.

As the wafer 37 is polished, excess slurry and removed materials exit the sink 58 through drain 60. After the polished surface of the wafer is sufficiently smooth, the dispenser 56 dispenses cleaning fluid instead of slurry while the polishing arm 50 continues to exert downward pressure on the wafer 37. As a result, the cleaning fluid flushes slurry and other contaminants on the wafer 37 and pad 20 down the drain 60. After the cleaning is finished, the polishing arm 50 is retracted from the platen 46 and the wafer 37 is removed from the wafer holder 52. Subsequently, another wafer can be placed on the wafer holder 52 and the above-described process can be repeated.

During the above exemplary CMP process, the wafer 37 is oscillated such that an outer edge portion of the wafer 37 spends a majority of the polishing time in contact with the inner and outer polishing regions 22 and 26, while the main body of the wafer 37 spends a majority of the polishing time in contact with the intermediate polishing region 24. The cushioned intermediate polishing region 24 is adapted to exhibit sufficient compressibility to achieve uniformity across the bulk of the wafer surface. Additionally, the reduced compressibility at the inner and outer polishing regions 22 and 26 functions to inhibit the degradation of process uniformity near the wafer edge. As a result, acceptable process uniformity across the entire wafer, including the region proximate the wafer edge, can be achieved.

Figure 4:
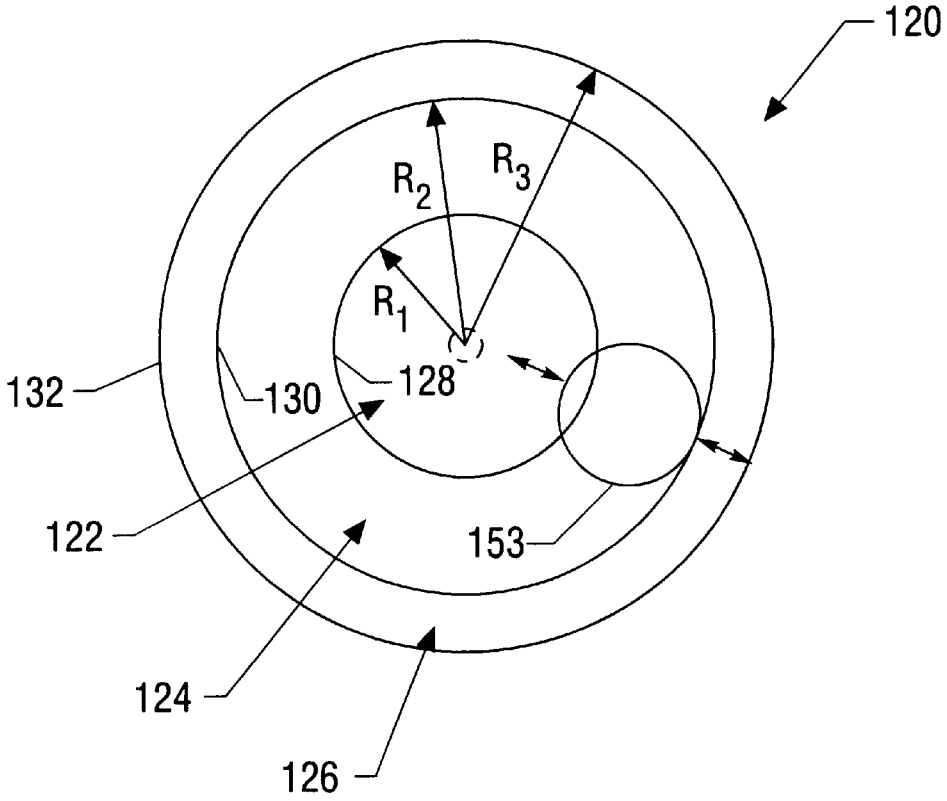
FIG. 4 is a schematic plan view of a polishing platen constructed in accordance with the principles of the present invention.
Figure 5:
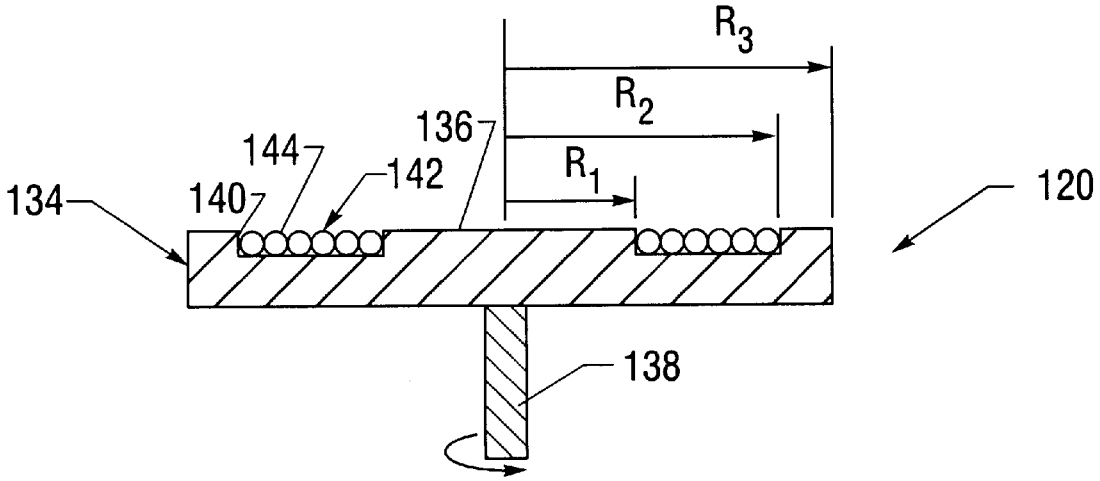
FIG. 5 is a cross-sectional view taken along section line 5—5 of FIG. 4.

FIGS. 4 and 5 illustrate an exemplary polishing platen 120 constructed in accordance with the principles of the present invention. The exemplary platen 120 includes at least first and second regions having different degrees of compressibility. For example, as shown in FIG. 4, the platen 120 includes an inner polishing region 122, an intermediate polishing region 124, and an outer polishing region 126. In one particular embodiment of the present invention, the intermediate polishing region 124 is more compressible than the inner and outer polishing regions 122 and 126. As shown in FIG. 4, the polishing regions 122, 124, and 126 are generally concentrically aligned relative to one another with the inner polishing region 122 being circular and the intermediate and outer polishing regions 124 and 126 being generally annular. However, it will be appreciated that the present invention is not limited to such a specific configuration.

Referring again to FIG. 4, a first boundary 128 forming the outer boundary of the inner polishing region 122 is defined by a first radius $R_1$. Also, a second boundary 130 forming an outer boundary of the intermediate polishing region 124 is defined by a second radius $R_2$. Finally, a third boundary 132 coinciding with the outermost edge of the platen 120 and forming an outer boundary of the outer polishing region 126 is defined by a third radius $R_3$. As can be inferred from the above description, the inner polishing region 122 is defined by the first boundary 128, the intermediate polishing region, 124 is defined between the first and second boundaries 128 and 130, and the outer polishing region 126 is defined between the second and third boundaries 130 and 132. For many applications, the dimensions of $R_1$, $R_2$, and $R_3$ are the same as those previously specified with respect to the polishing pad 20 of FIGS. 1 and 2.

Referring now to FIG. 5, an exemplary construction configuration for the polishing platen 120 is illustrated. As shown in FIG. 5, the polishing platen 120 includes a polishing deck or plate 134 having a top side 136 adapted for supporting a polishing pad. The bottom of the polishing plate 134 is shown coupled to a drive mechanism such as a drive spindle 138 adapted for rotating the polishing plate 134 about its central axis. The top side 136 of the polishing plate 134 defines a recess 140 that coincides or corresponds generally with the intermediate polishing region 124. In one particular embodiment of the present invention, the recess 140 has a depth of about 100 mm. A cushioning component 142 is disposed within and at least partially fills the recess 140. As shown in FIG. 5, the recess 140 and the cushioning component 142 both have a generally annular configuration. However, it will be appreciated that the present invention is not limited to such a configuration.

For many applications, the polishing platen plate 134 is made of a relatively hard, rigid and non-compressible material such as carbon steel. By contrast, for many applications, the cushioning structure 142 is made of a relatively soft, flexible and compressible material such as shock absorbent foam, felt or a media filled bladder. In the particular embodiment illustrated in FIG. 5, the cushioning structure 142 is shown as a plurality of tubular bladders 144 that extend around the recess 140 and are at least partially filled with fluid. Although the bladders 144 are shown as tubular members, it will be appreciated that the present invention also includes other bladder configurations such as a single annular bladder, or multiple radially spaced bladders. Furthermore, spokes, ties or reinforcing members can be disposed between, around, along or within the bladders to control or limit the amount the bladders deform when compressive forces are applied to portions of the bladders. For example, the spokes, ties or reinforcing members can be arranged to inhibit a first portion of a given bladder from over-expanding when a compressive force is applied to a second portion of such bladder.

The above-described bladders can be filled with any number of different types of fluids. For example, the bladders can be filled with gasses such as ambient air or nitrogen. Alternatively, the bladders can be filled with liquid such as water. When used as a cushioning structure, the bladders function to absorb platen imperfections and dampen process variations. Specifically, the cushioning structures 142, that may include bladders or other resilient material, allow portions of a polish pad mounted on the platen 120 to flex, bend or compress during CMP operations.

Figure 6:
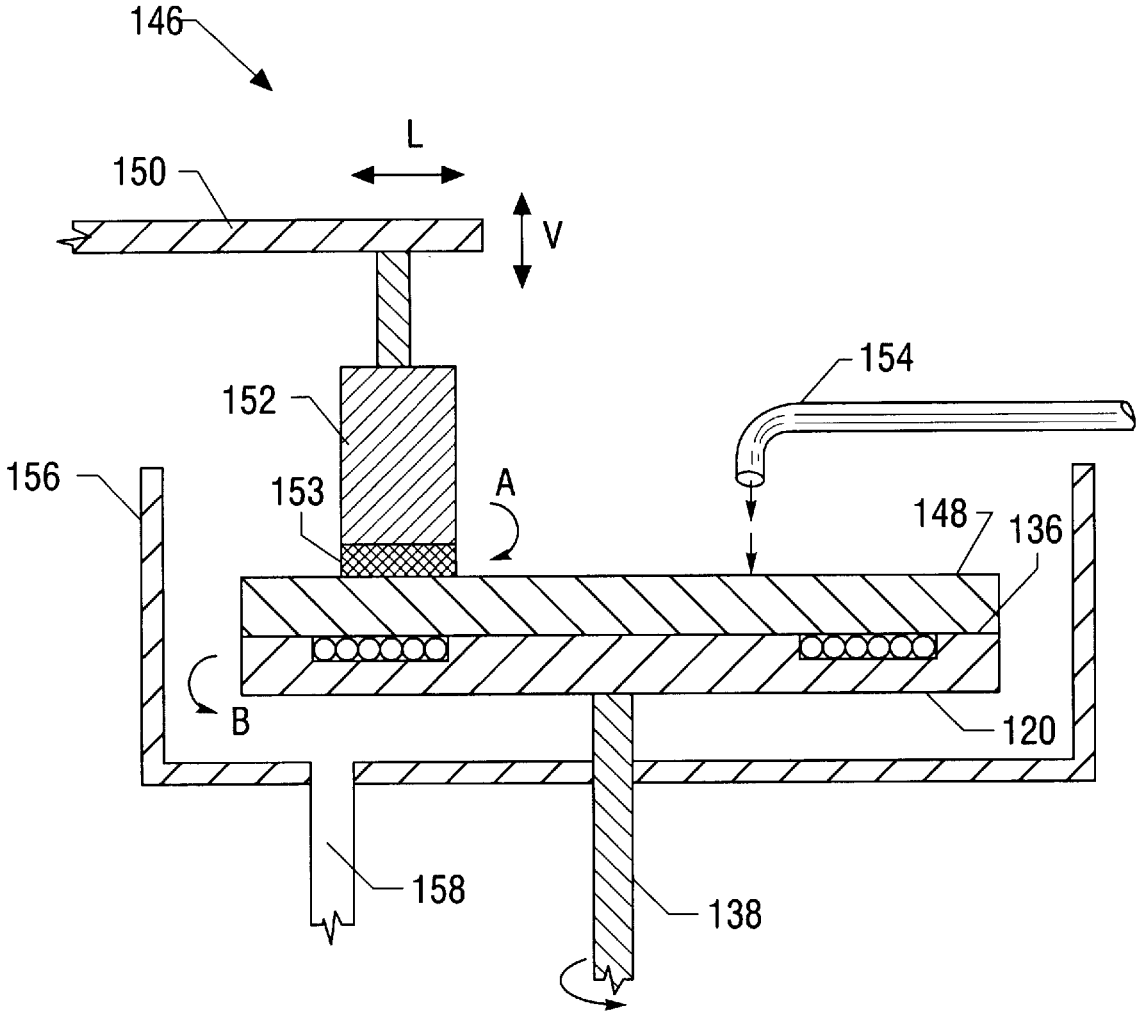
FIG. 6 is a schematic cross-sectional view of a polishing system incorporating the polishing platen of FIG. 4.

FIG. 6 shows a cross-sectional view of a polishing system 146 incorporating the polishing platen 120. The system 146 includes a polishing pad 148 supported on the top side 136 of the polishing platen 120. In one particular embodiment, the pad has a substantially constant thickness and is made of a relatively hard non-compressible material such as polyurethane without any cushioning layer. However, it will be appreciated that the present invention is not limited to such pads and includes other type of pad configurations including, for example, conventional pads as well as pads similar to the polishing pad 20 depicted in FIGS. 1 and 2. Additionally, pads with central openings can also be used.

The system 146 also includes a polishing arm 150 including a wafer holder 152 such as a chuck. A wafer 153 is shown with its back side (opposite the side to be polished) removably secured to the wafer holder 152 by convention means such as vacuum suction. The polishing arm 150 is movable both laterally (direction L) and vertically (direction V). The system also includes a fluid dispenser 154 for dispensing a fluid onto the pad 148, and a sink 156 for containing materials propelled from the pad 148. The sink 156 is in fluid communication with a drain 158 for draining materials that collect in the sink 156.

The system 146 operates in a similar manner to the polishing system 44 previously described with respect to FIG. 3. In an exemplary operating sequence, the polishing platen 120 is rotated by the drive spindle 138, and the wafer 153 is rotated by the wafer holder 152. Concurrently, a polishing fluid such as a polishing slurry is applied to the pad 148 from the fluid dispenser 154. Next, the wafer 153 is pressed down against the pad 148 by the polish arm 150, and the wafer 153 is radially oscillated across the polishing pad 148. For example, the wafer 153 can be oscillated between the center and the outer boundary of the polish pad 148.

As the wafer 153 is oscillated, the underlying polishing pad 148 is pressed against the top side 136 of the polishing platen 120. At the non-recessed portions of the polish platen 120, the pad 148 is firmly supported by the inner and outer regions 122 and 126 of the polishing platen 120. Consequently, as the pad is oscillated, minimal compression of the pad 148 occurs over the inner and outer 122 and 126 regions. In contrast, when the wafer 153 is oscillated across the intermediate region 124, the cushioning structure 142 of the polishing platen 120 allows the portion of the pad 148 corresponding to such intermediate region 124 to flex or compress such that system variations are dampened and acceptable process uniformity is achieved.

While the wafer 153 is polished, excess slurry and removed materials exit the sink 156 through the drain 158. After the polished surface of the wafer is sufficiently smooth, the dispenser 154 dispenses cleaning fluid instead of slurry while the polishing arm 150 continues to exert downward pressure on the wafer 153. As a result, the cleaning fluid flushes slurry and other contaminants on the wafer and pad 148 down the drain 158. After the cleaning is finished, the polishing arm 150 is retracted from the platen 120 and the wafer 153 is removed from the wafer holder 152. Subsequently, another wafer can be placed on the wafer holder 152 and the above-described process can be repeated.

During the above exemplary CMP process, the wafer 153 is oscillated such that an outer edge portion of the wafer 153 spends a majority of the polishing time in contact with the portion of the pad 148 that corresponds to the inner and outer regions 122 and 126, while the main body of the wafer 153 spends a majority of the polishing time in contact with the portion of the pad 148 that corresponds to the intermediate polishing region 124. The combination of compressible and non-compressible regions, as provided by the inner, intermediate and outer regions 122, 124 and 126 of the platen 120, allows for acceptable process uniformity across the bulk of the wafer 153, along with improved process uniformity near the wafer edge.

With regard to the foregoing description, it is to be understood that changes may be made in detail, especially in matters of the construction materials employed and the size, shape and arrangement of the parts without departing form the scope of the present invention. For example, a given platen or pad can be divided into more or less than three regions without departing from the scope of the present invention. Additionally, although the platens illustrated in the present application relate to rotatable platens, it will be appreciated that the principles of the present invention also apply to other platen designs such as linear oscillating platens. Furthermore, platens and pads in accordance with the principles of the present invention can be used with single head or multi-head polishing devices. It is intended that the specification and depicted aspects of the invention be considered exemplary only with a true scope and spirit of the invention being indicated by the broad meaning of the following claims.

We claim:

1. A polishing pad comprising:

a pad structure having at least first and second polishing regions defined along a polishing surface of the pad structure, the first polishing region being less compressible than the second polishing region, wherein the pad structure includes:

a polishing component having a first side forming the polishing surface and a second side positioned opposite from the first side, the second side defining a recessed portion that corresponds with the second polishing region such that the polishing component has a greater thickness at the first polishing region as compared to the second polishing region; and a cushioning component at least partially filling the recessed portion of the polishing component, the cushioning component being softer than the polishing component.

2. The polishing pad of claim 1, wherein the polishing component is made of a polyurethane material.

3. The polishing pad of claim 2, wherein the cushioning component is made of a foam material.

4. The polishing pad of claim 2, wherein the cushioning component is made of a felt material.

5. The polishing pad of claim 1, further comprising a third polishing region that is less compressible than the second polishing region.

6. The polishing pad of claim 5, wherein the first polishing region is an inner polishing region, the second polishing region is an intermediate polishing region, and the third polishing region is an outer polishing region.

7. The polishing pad of claim 6, wherein the inner polishing region is generally circular and the intermediate and outer polishing regions are generally annular, and wherein the central polishing region, the intermediate polishing region, and the outer polishing region are concentric with respect to one another.

8. A polishing pad comprising:

a pad structure having at least first and second polishing regions defined along a polishing surface of the pad structure, the first polishing region being less compressible than the second polishing region, wherein the pad structure includes a polishing component forming the polishing surface, the polishing component defining a recessed portion that corresponds with the second polishing region, the recessed portion being at least partially filled with a cushioning component that is softer than the polishing component.

9. A polishing platen comprising:

a platen structure having at least first and second regions adapted for supporting a polishing pad, the first region being less compressible than the second region, wherein the platen structure includes a platen plate including a recessed portion that corresponds with the second region, and the platen structure further comprises a cushioning structure that at least partially fills the recessed portion, the cushioning structure being more compressible than the platen plate.

10. The polishing platen of claim 9, wherein the cushioning structure is selected from the group of materials consisting of foam or felt.

11. The polishing platen of claim 9, wherein the cushioning structure comprises at least one bladder at least partially filled with fluid.

12. The polishing platen of claim 11, wherein the fluid is a liquid.

13. The polishing platen of claim 11, wherein the fluid is a gas.

14. The polishing platen of claim 11, wherein the at least one bladder includes a plurality of bladders disposed within the recessed portion of the platen plate.

15. The polishing platen of claim 9, wherein the platen structure includes first, second and third regions adapted for supporting a polishing pad, the first and third regions being less compressible than the second region.

16. The polishing platen of claim 15, wherein the first region is an inner radial region, the second region is an intermediate radial region, and the third region is an outer radial region.

17. The polishing platen of claim 16, wherein the inner radial region is generally circular and the intermediate and outer radial regions are generally annular.

18. The polishing platen of claim 16, wherein the platen structure includes a platen plate including a recessed portion that corresponds with the intermediate radial region, and the platen structure further comprises a cushioning structure that at least partially fills the recessed portion, the cushioning structure being more compressible than the platen plate.

19. The polishing platen of claim 9, wherein the polishing pad is mounted on the platen structure.

20. The polishing platen of claim 19, wherein the polishing pad has a substantially constant thickness.

21. A system for polishing semiconductor wafers, the system comprising:

a polishing platen;

a drive mechanism for rotating the polishing platen;

a polishing pad mounted on the polishing platen, the polishing pad including a polishing surface having first and second polishing regions and a polishing component that provides the polishing surface of the pad and also defines a recess that corresponds to the second polishing region;

a source of polishing fluid adapted for providing polishing fluid to the polishing pad; and a cushioning component that at least partially fills the recess, the cushioning component being softer than the polishing component.

22. The system of claim 21, wherein the polishing platen includes a platen plate having a surface adapted for supporting the polishing pad, the platen plate defining a recess that is generally aligned with the second polishing region of the polishing pad, and a cushioning structure that at least partially fills the recess, the cushioning structure being more compressible than the platen plate.

23. A method for polishing a semiconductor wafer comprising:

providing a polishing pad mounted on a polishing platen, the polishing pad including a polishing surface having at least first and second polishing regions, the second polishing region being more compressible than the first polishing region, said polishing pad defining a recessed portion that corresponds with the second polishing region;

positioning a cushioning component at least partially in the recessed portion, the cushioning component being softer than the polishing pad, rotating the polishing pad;

pressing the semiconductor wafer against the polishing pad; and radially oscillating the semiconductor wafer across the first and second polishing regions.

24. The method of claim 23, further comprising the step of rotating the semiconductor wafer.

25. The method of claim 23, wherein the polishing surface includes first, second, and third radial polishing regions, the second polishing region being more compressible than the first and third radial polishing regions.

26. The method of claim 25, wherein the first radial polishing region is a central radial region, the second radial polishing region is an intermediate radial region, and the third radial polishing region is an outer radial region, and wherein the wafer is radially oscillated across the central, intermediate and outer radial regions.

* * * * *